United States Patent [19]

Caldera

[11] 4,363,173

[45] Dec. 14, 1982

[54] BOLT HOLE LOCATING AND MARKING TOOL

[76] Inventor: Joseph B. Caldera, 427 W. 10th, Escondido, Calif. 92026

[21] Appl. No.: 842,684

[22] Filed: Oct. 17, 1977

[51] Int. Cl.[3] ..... B25H 7/04; B25D 1/00

[52] U.S. Cl. ..... 33/180 R; 33/189

[58] Field of Search ..... 33/189, 191, 192, 180 R; 30/367; 29/254; 125/40; 81/1

[56] References Cited

U.S. PATENT DOCUMENTS

| | | | |
|---|---|---|---|
| 808,704 | 1/1906 | Van Meter | 81/1 |
| 912,052 | 2/1909 | Albertson | 33/191 |
| 3,406,460 | 10/1968 | Crowell | 33/180 R |

FOREIGN PATENT DOCUMENTS

| | | | |
|---|---|---|---|
| 207580 | 2/1960 | Fed. Rep. of Germany | 33/189 |
| 636815 | 5/1950 | United Kingdom | 33/189 |

*Primary Examiner*—Willis Little
*Attorney, Agent, or Firm*—Brown & Martin

[57] ABSTRACT

A bolt hole locating and marking tool includes a base member that serves as a support base and predetermined distance locator, a tubular guide member secured to the base member and extending outward from an aperture in the base member with an elongated impact member having a sharp point on one end and mounted within the tubular member so that the point can protrude from the tubular member beyond the aperture in the base member for engagement with a surface for providing a mark or indication. This tool includes handle or grip at the upper end thereof and a spring disposed between the handle and the tubular member for supporting the impact member with the point just short of protruding from the aperture. A locking member secures the impact member within the guide tube.

1 Claim, 4 Drawing Figures

BOLT HOLE LOCATING AND MARKING TOOL

BACKGROUND OF THE INVENTION

The present invention relates to tools and pertains particularly to an impact tool for locating and marking bolt hole positions.

In the building industry, framing footing and other support structure is frequently secured by bolts to concrete foundations or slabs. For a fast and economical construction, many framing members for attachment to foundations and slab flooring is pre-drilled to receive bolts for bolting the member to the foundation or flooring structure. It is necessary under such circumstances to provide accurate location of the bolts for receiving or cooperating with the holes in the framing members. In many cases the bolts are placed in the foundation or slab flooring after the flooring is poured. In order to do so, it is necessary to accurately locate the position where the bolt must be placed within the slab or flooring.

While the location of such bolt holes can be done with the usual measuring implements, such as rulers, tapes and the like, and the marking thereof can be done by any suitable means, such as marking pens, chalk or chisels, a faster, more reliable means is desirable.

Accordingly it is desirable that a reliable, fast, and effective locating and marking tool be available for locating and marking bolt hole positions.

SUMMARY AND OBJECTS OF THE INVENTION

Accordingly it is the primary object of the present invention to overcome the above problems of the prior art.

Another object of the present invention is to provide a fast, reliable and effective bolt hole locating and marking tool.

Another object of the present invention is to provide a marking tool that is simple, rugged and effective for marking concrete and the like surfaces.

In accordance with the primary aspect of the present invention, an impact marking tool comprises a base member having means for establishing a predetermined distance and an impact member mounted on the base member and having a sharp portion for establishing a mark upon impact engagement with a surface for indicating the predetermined distance.

BRIEF DESCRIPTION OF THE DRAWING

The above and other objects and advantages of the present invention will become apparent from the following description, wherein.

DETAILED DESCRIPTION OF A PREFERRED EMBODIMENT

Figure 1:
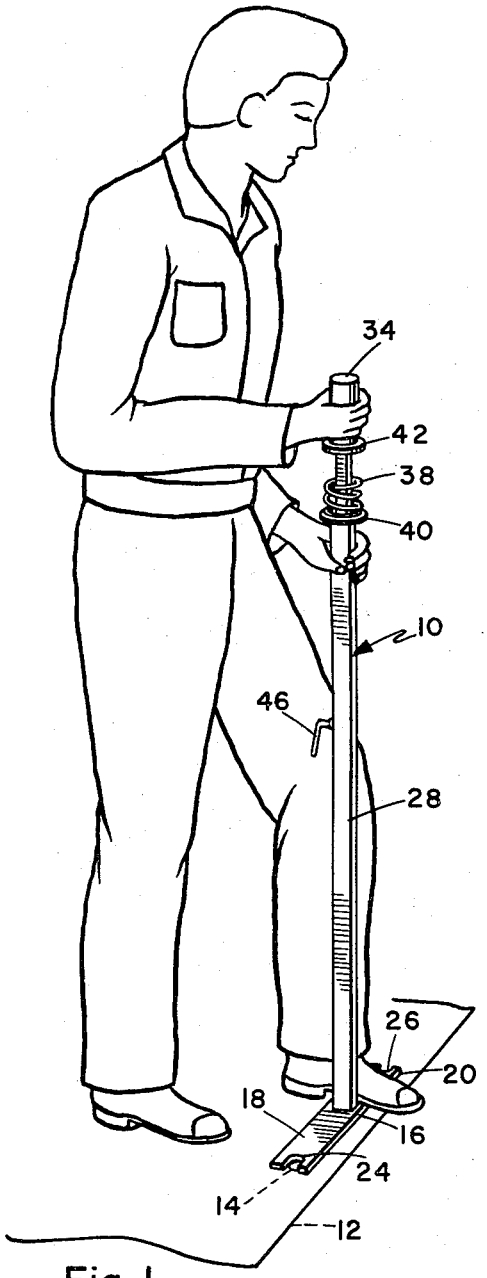
FIG. 1 illustrates the tool in use.
Figure 2:
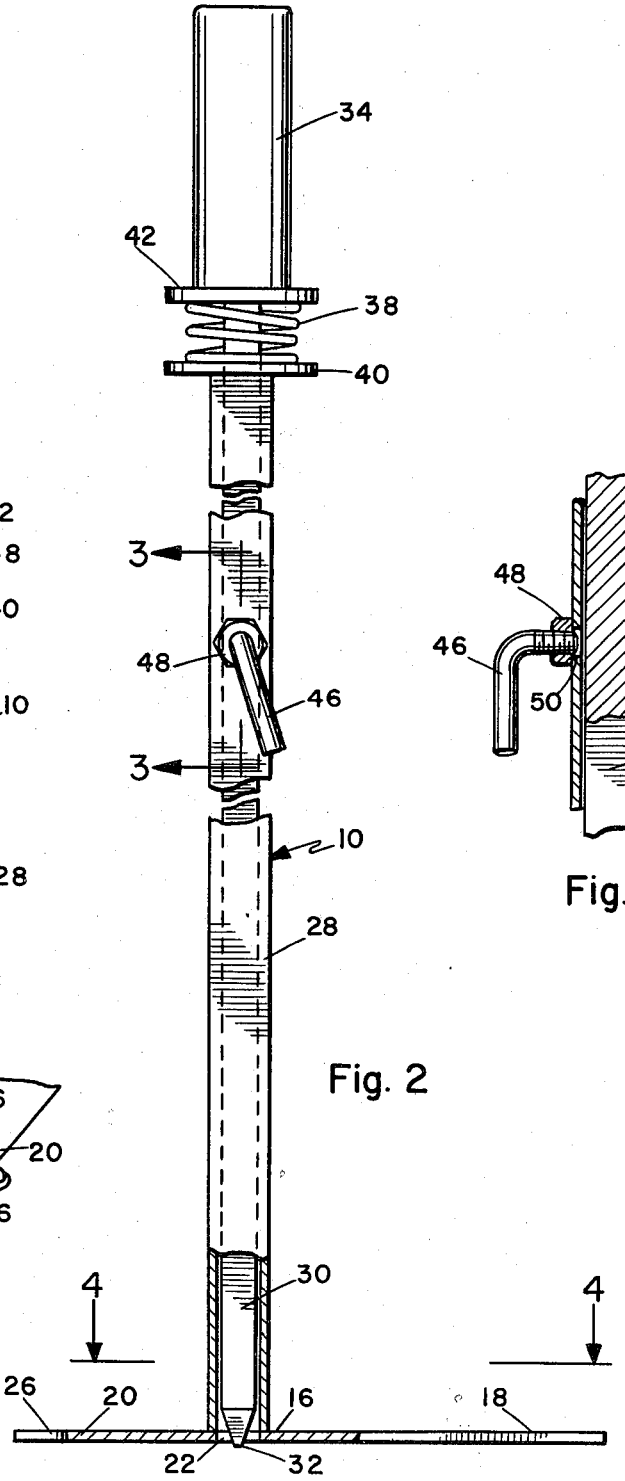
FIG. 2 is a side elevation view of the tool with portions cut away.
Figure 3:
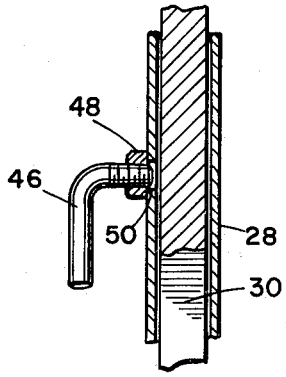
FIG. 3 is a sectional view taken on line 3—3 of FIG. 2.

Turning now to FIG. 1 of the drawing, a tool in accordance with the present invention is designated generally by the numeral 10 and shown in use. This tool is designed to establish predetermined distances and to mark such distances on surfaces, such as concrete surfaces of a floor and the like 12. The distances, for example, may be established between an existing bolt hole 14 and a position for a second bolt hole.

Many of the distances between bolts securing framing to foundations, floors and the like are established by codes. Such codes also establish the distance between walls of adjacent units, such as condominium units for example. Many codes for example, require double wall construction between adjacent units for sound proofing and for serving as a fire wall. Such distances are established by code and must be maintained precisely.

Figure 4:
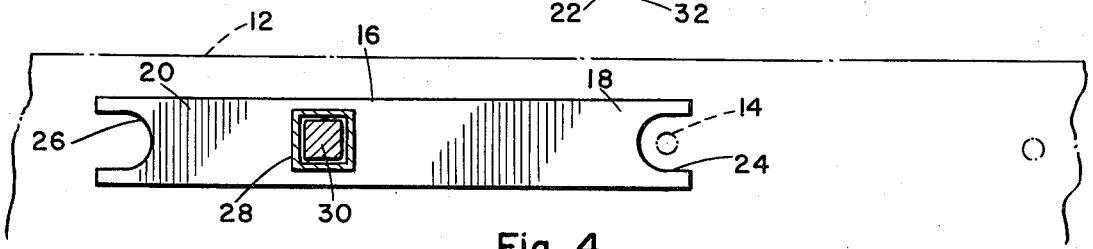
FIG. 4 is a sectional view taken on line 4—4 of FIG. 2.

The tool, in accordance with the invention, comprises a base member 16 which in this case is constructed of an elongated flat metal strap member having means defining first and second predetermined distance measuring arms or members 18 and 20. These arms establish a distance between the center of a bore or aperture 22 through which a marking tool protrudes and the ends or an indicating portion of the ends of the distance measuring arms 18 and 20. In the illustrated example, the ends of the arms include cut out portions 24 and 26 having a generally semi-circular configuration for partially encircling a bolt or bolt hole, such as 14 as illustrated in FIG. 4. This permits one to precisely locate and mark a second hole with respect to a predetermined or established hole or mark. The device may be constructed to have any number of measuring arms or to have adjustble arms for selectively adjusting the predetermined distances.

Extending upward from the hole or aperture 22 and in co-axial alignment therewith is a tubular guide member 28 which extends to a sufficient height as illustrated in FIG. 1 to be easily handled and manipulated by an average size workman standing in the upright position and marking on a floor at his feet. This permits the worker to work from the standing position and thus reduces the tiring effect of stooping over and the like. This enhances the rapidity with which the tool can be utilized.

The tubular guide member 28 serves as guide means for an elongated inertial impact member 30 having a sharp inscribing or marking point 32 at the lower end thereof and a suitable handle or grip 34 at the upper end thereof. The point 32 of the impact tool 30 is preferbly hardened and of sufficient sharpness to easily make a noticeable imprint or indentation on a cement slab, such as a floor or the like. The guide member 28 is secured to the base member 16 in a suitable manner such as by welding. It will be appreciated, however, that the base member may be detachably secured to the guide member 28 such that different standard size base members may be secured thereto for establishing different distances or predetermined distances between holes and the like.

The impact member is supported with the point 32 just short of protruding below the lower or support surface of the base member 16. This impact member because of its length will have substantial mass and inertial effect and is supported by suitable resilient shock absorber, such as a coil spring 38 disposed between an annular flange 40 secured to the upper end of the tubular guide member 28 and an annular flange 42 secured to the impact member 30 at the lower end of the handle or grip 34. This resilient support means supports the impact member in a position with the point 32 withdrawn such that the base may be rested on a flat surface of a slab or the like without interference from the point 32. The support means 36 permits the impact member 30 to be drawn upward and forced rapidly downward and beyond the lower end of the support or base member 16, such that it is stopped only by resistance from the face of the slab or the like on which the mark is being made. It will of course be appreciated that the tool may be used for marking steel plate and the like such as for ship building and the like. It should also be appreciated that although the tubular member is illustrated as being substantially square in configuration and the impact member 30 similarly of a similar configuration the members may have any suitable cross sectional configuration.

An additional feature of the apparatus comprises locking means in the form of a generally L-shaped clamp screw 46, cooperating with a nut 48 secured to the tubular member 28 co-axially with an opening or bore 50. The screw or bolt 46 may be screwed inward with the inner end thereof engaging the surface of the impact member 30 and clamping or securing the tube and impact members together for ease in carrying or transporting or the like.

In use, a tool is selected having the desired predetermined distance or length of the arms 18 and 20 suitable for the particular application. The tool is then positioned such that the predetermined distance is established between the end or a designated position adjacent the end of either one of the arms 18 and 20 and the point 32. Upon establishing the position of the tool, the impact member is unclamped by releasing the clamp screw 46 and the impact member is then pulled upward and either permitted to fall downward for sharp impact engagement by the point 32 thereof, into the surface on which the base is resting or by a sharp downward force being applied by the operator to the impact member 30. The sharp point 32 makes an indentation in the surface of the slab or the like on which the base member 16 is resting. It should be noted that the device can be easily utilized for marking positions on vertical walls and on ceilings and the like.

While the present invention has been illustrated and described by means of a specific embodiment, it is to be understood that numerous changes and modifications may be made therein without departing from the spirit and scope of the invention as defined in the appended claims.

Having described my invention, I now claim:

1. A self contained hand actuated inertial impact marking tool for establishing and marking predetermined distances on concrete and the like, comprising:

an elongated generally flat rectangular base member having a support face and an aperture therein intermediate the ends thereof, the length thereof between said aperture and said ends defining means for establishing predetermined distances;

an elongated tubular guide member secured at one end to, and extending upward from said base member in alignment with said aperture;

a hand actuated inertial impact member defined by an elongated bar having a sharp point on the lower end and an elongated, cylindrical grip handle adapted to extend through and be gripped by the hand on the upper end mounted in said tubular guide member on said base member and having said sharp point positioned for extending through said aperture for establishing a mark upon impact engagement with a surface, said bar and said tubular member having sufficient length extending from said base member to extend from said base member at the foot of a workman upward to his waist, to enable a workman in the upright position to grasp the grip handle in his hand and said elongated bar having sufficient mass to enable hand actuation to mark on a concrete floor at the feet of said workman; and a coil spring disposed between a pair of opposed annular flanges disposed respectively on the upper end of said tubular member and adjacent said handle on said elongated bar for normally supporting said impact member so that said point does not protrude beyond said support face, a semi-circular cut out at each end of said base member for receiving a bolt, and clamping means for clamping said elongated bar to said tubular member.

* * * * *